US006549171B1

(12) United States Patent
Mailloux

(10) Patent No.: US 6,549,171 B1
(45) Date of Patent: Apr. 15, 2003

(54) CONSTRAINED FEED TECHNIQUES FOR PHASED ARRAY SUBARRAYS

(75) Inventor: Robert J. Mailloux, Wayland, MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 388 days.

(21) Appl. No.: 09/649,856

(22) Filed: Aug. 28, 2000

(51) Int. Cl.[7] ..... H01Q 3/34
(52) U.S. Cl. ..... 343/754; 343/853; 342/373
(58) Field of Search ..... 343/754, 853; 342/376, 373; H01Q 3/26, 3/30, 3/34, 3/36, 3/38, 3/40

(56) References Cited

U.S. PATENT DOCUMENTS 4,939,527 A * 7/1990 Lamberty et al. ..... 343/754

5,734,345 A * 3/1998 Chen et al. ..... 343/754

* cited by examiner

*Primary Examiner*—Michael C. Wimer
(74) *Attorney, Agent, or Firm*—William G. Auton

(57) ABSTRACT

A constrained feed can enable a phased array to be fed from a number of subarray ports while maintaining good sidelobe control. The invention pertains to using constrained feed networks, like Rotman lenses, Butler matrices and waveguide networks instead of a single space feed, to produce these subarrays. The formed subarrays are partially overlapped, and this is required to develop good sidelobe control. The invention solves the problem of having high sidelobes when an array is fed by contiguous, uniformly illuminated subarrays and so allows optical time delay, digital time delay and limited field of view scanning with a constrained network while maintaining low sidelobe radiation.

2 Claims, 6 Drawing Sheets

CONSTRAINED FEED TECHNIQUES FOR PHASED ARRAY SUBARRAYS

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to antennas and more specifically the invention pertains to a phased array antenna feed system.

Large arrays are often treated as arrays of smaller subarrays for the purpose of simplifying the array control and reducing cost. Two major applications of subarray techniques are for limited field of view scanning and for time delay compensation of phase steered arrays.

Using space-fed overlapped subarray technique, it is possible to divide an array into subarrays and provide good performance for two applications that require subarrays. One application is for scanning over a limited field of view, where in the subarray is used to reduce the number of phase controls. A second application is to insert time delay at the subarray ports, while using phase shifters at the antenna elements.

Unfortunately, space fed systems have large volume, and so for many applications it is desirable to build arrays with fully constrained transmission line networks and power dividers. This can be done most simply using contiguous, uniformly illuminated subarrays, but that causes large sidelobes for both of these applications. Alternative partial overlapping techniques have been developed for constrained networks, and these have been useful for limited field of view scanning applications, but they are relatively complex to construct, and their sidelobe control is limited. These techniques are even more limited for the application of inserting time delay at the subarray ports of phase steered arrays, because this application implies use of very large subarrays, and these techniques are only suitable for overlapping a relatively small number of elements.

Current phased array feed systems are described in the following U.S. Patents, the disclosures of which are incorporated herein by reference:

U.S. Pat. No. 5,694,134, Dec. 2, 1997, PHASED ARRAY ANTENNA SYSTEM INCLUDING A COPLANAR WAVEGUIDE FEED ARRANGEMENT, Barnes, Frank;

U.S. Pat. No. 5,365,239, Nov. 15, 1994, FIBER OPTIC FEED AND PHASED ARRAY ANTENNA, Stilwell, Jr., P. Denzil;

U.S. Pat. No. 5,087,922, Feb. 11, 1992, MULTI-FREQUENCY BAND PHASED ARRAY ANTENNA USING COPLANAR DIPOLE ARRAY WITH MULTIPLE FEED PORTS, Tang, Raymond, Fullerton, Calif. Lee, Kuan M., Brea, California Chu, Ruey S.;

U.S. Pat. No. 4,757,318, Jul. 12, 1988, PHASED ARRAY ANTENNA FEED, Pulsifer, Paul I., Kanata, Canada Cornish, William D. Nepean, Canada Conway, Larry J.;

U.S. Pat. No. 4,566,013, Jan. 21, 1986, COUPLED AMPLIFIER MODULE FEED NETWORKS FOR PHASED ARRAY ANTENNAS, Steinberg, Richard;

U.S. Pat. No. 4,446,463, May 1, 1984, COAXIAL WAVEGUIDE COMMUTATION FEED NETWORK FOR USE WITH A SCANNING CIRCULAR PHASED ARRAY ANTENNA, Irzinski, Edward P.;

U.S. Pat. No. 4,394,660, Jul. 19, 1983, PHASED ARRAY FEED SYSTEM, Cohen, Leonard D.; and U.S. Pat. No. 3,739,389, Jun. 12, 1973, DUAL FUNCTION FEED SYSTEM FOR PHASED-ARRAY RADAR, Bowman, David F.

To date, I know of no constrained feed technique that can provide good pattern control for large subarrays, particularly for large space fed systems.

Although effective subarraying can be readily implemented using space feeds, it has remained very difficult to produce good pattern control with constrained feeds. There is a need for several new solutions to the problem, as applied to one dimensional arrays. The extension to two-dimensional scanning can be accomplished by cascading the beamformer networks. It is expected that these techniques will enable the fabrication of low sidelobe arrays with very large constrained subarrays.

SUMMARY OF INVENTION

The invention is a procedure and associated hardware to enable a phased array to be fed from a number of subarray ports while maintaining good sidelobe control. The invention pertains to using constrained feed networks, like Rotman lenses, Butler matrices and waveguide networks instead of a single space feed, to produce these subarrays. The formed subarrays are partially overlapped, and this is required to develop good sidelobe control.

The invention solves the problem of having high sidelobes when an array is fed by contiguous, uniformly illuminated subarrays and so allows optical time delay, digital time delay and limited field of view scanning with a constrained network while maintaining low sidelobe radiation.

The object of the invention is to develop a new contrained feeding technique for limited field of view arrays and time delayed subarrays that has good sidelobe control. These applications are needed for space based radar systems, and a number of ground and airborne array systems for both radar and communication.

This object together with other objects, features and advantages of the invention will become more readily apparent from the following detailed description when taken in conjunction with the accompanying drawings wherein like elements are given like reference numerals throughout.

DESCRIPTION OF THE PREFERRED EMBODIMENT

Figure 1:
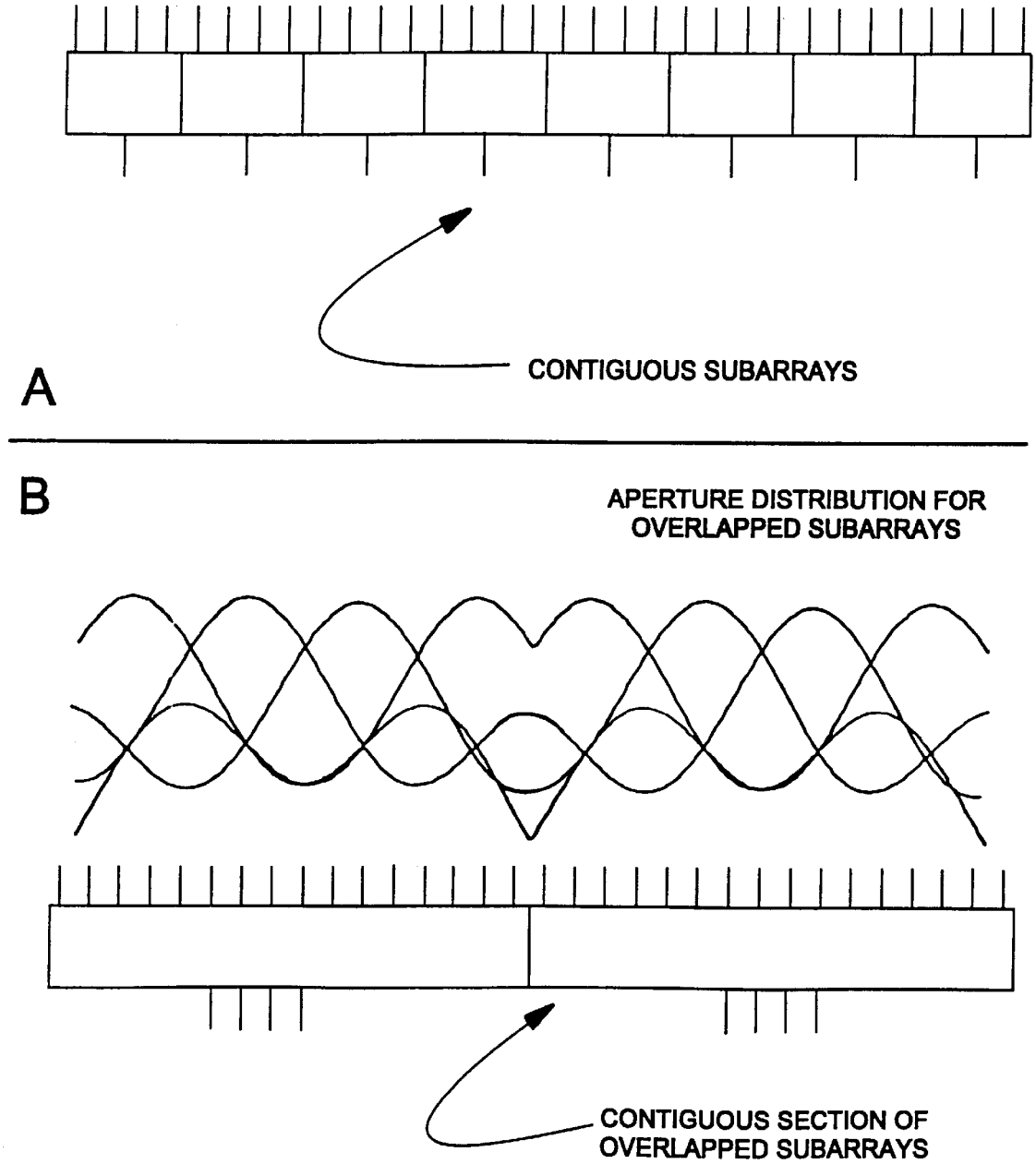
FIGS. 1A and 1B are illustrations of contiguous subarrays and contiguous sections of overlapped subarrays which are adjacent to each other and shares a radiating element.
Figure 2:
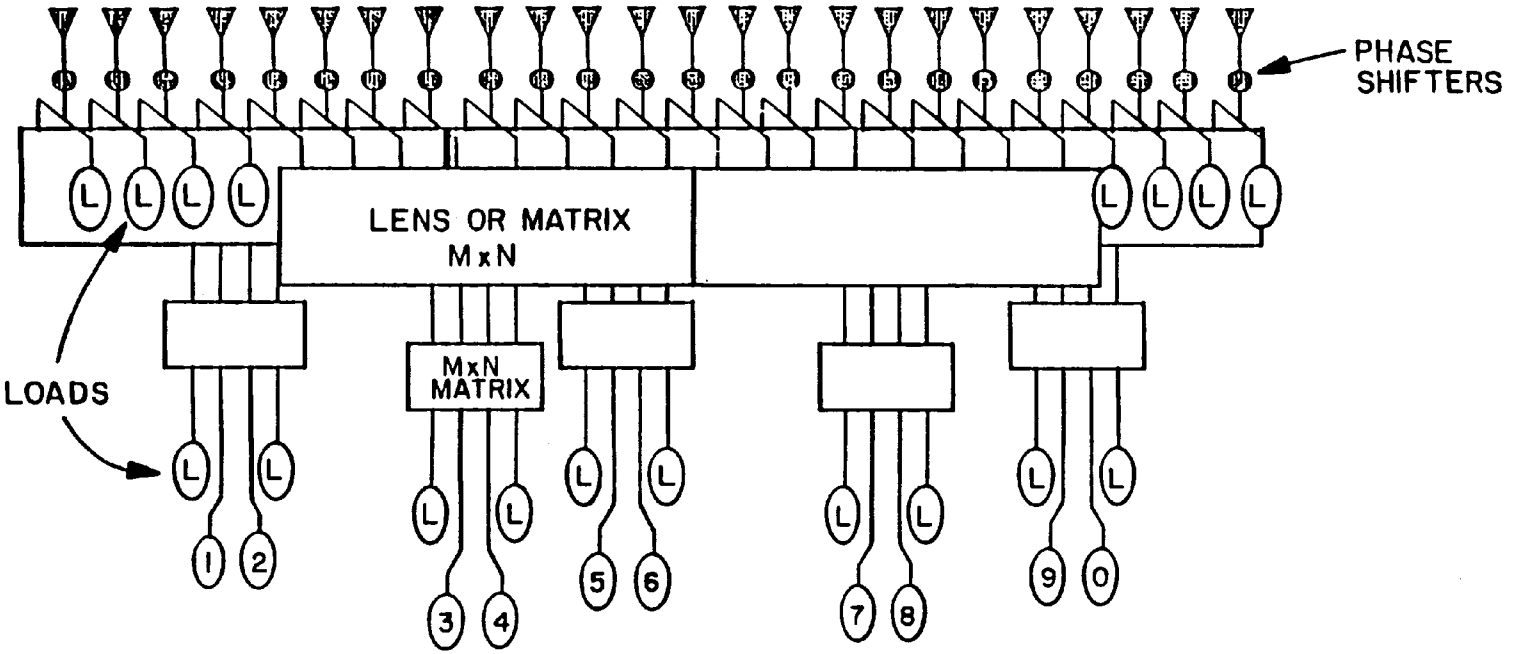
FIG. 2 is an illustration of partially overlapped sections of overlapped subarrays.

The basic invention consists of using a number of smaller, completely overlapped subarrays as sections of a larger array. The accompanying draft entitled "Constrained Feed Techniques for Limited Field of View Scanning or Time Delay Steering" explains the two most basic configurations of this invention as applied particularly to the case of providing time delay control of a phase steered array. FIGS. 1B and 2 show these configurations, while FIG. 1A shows conventional uniformly illuminated subarrays mounted contiguously in the array so as to form a large aperture.

The overlapped subarray networks that are the basic building block of this invention are themselves well understood within the state of the art. They combine some primary aperture, in this case a lens or multiple beam network as shown in FIG. 2 with M input ports and N output ports that connect the antenna elements. This system is fed by an M×M multiple beam network (a Butler Matrix or Rotman lens, or this whole M×M network could be implemented with digital beam forming). It is well known that this combination produces overlapping aperture distributions (or subarrays) at the N elements, when any two of the M-input ports of the multiple beam feed network are fed microwave power. It is also well known that the radiating subarray patterns have a flat-topped shape, and that they have advantageous properties for the two applications discussed.

Figure 3:
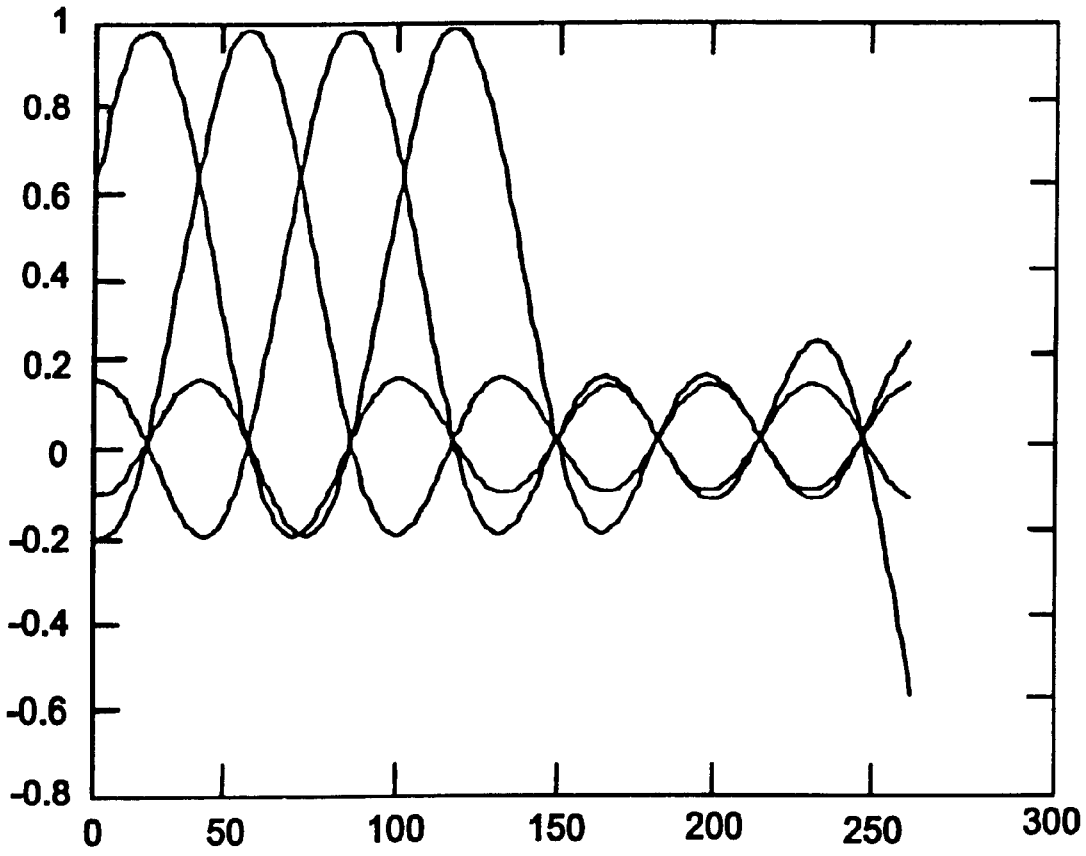
FIGS. 3–6 are charts of array performance.
Figure 4:
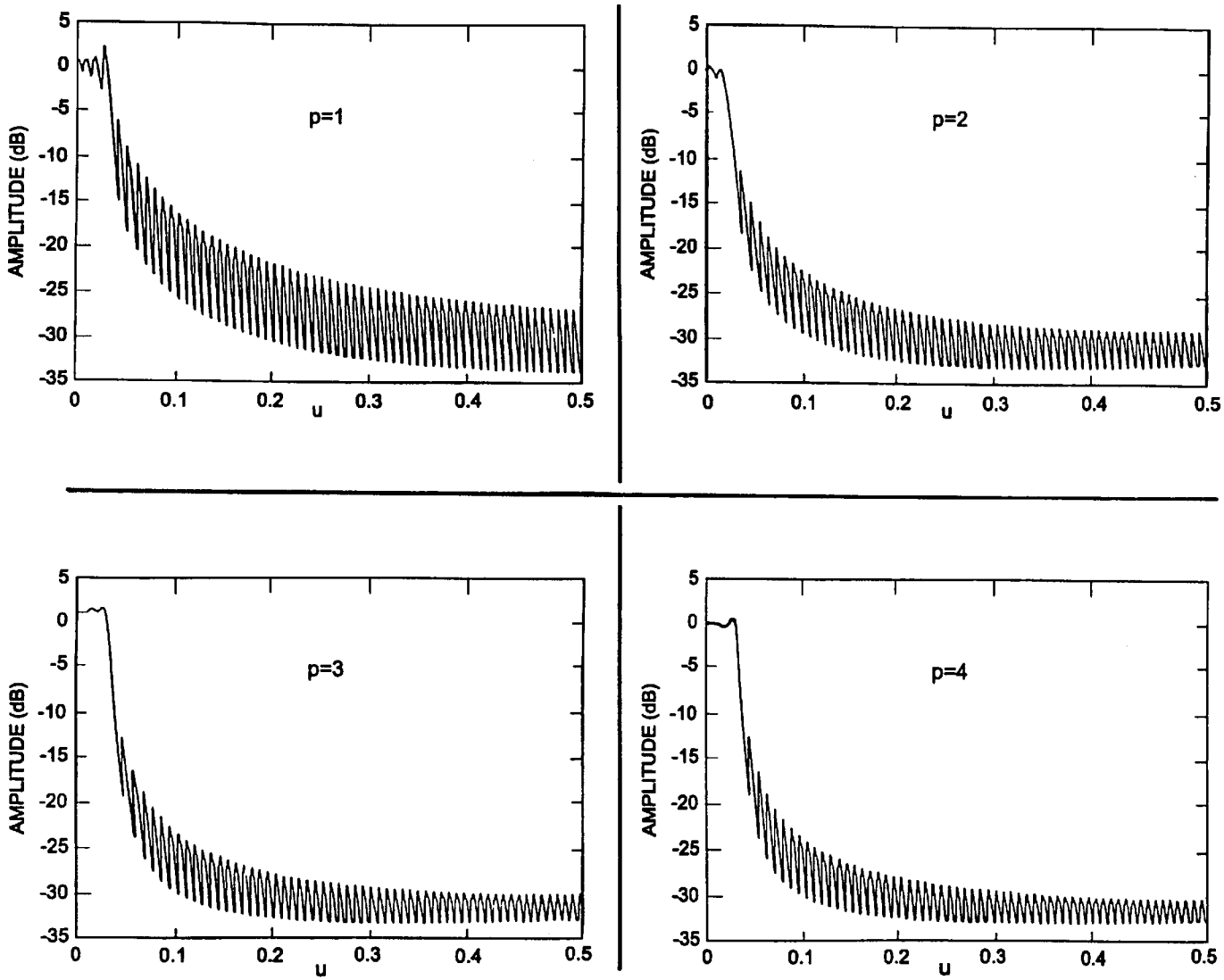

All of the above advantageous properties pertain when one subarraying feed excites all the array elements. In this case the subarrays are referred to as "fully or completely overlapped" in the literature. In the present invention these fully overlapped networks are used as sections of the larger array, where they are simply mounted contiguously as in FIG. 1B or partially overlapped as in FIG. 2. The partial overlapped geometry has about 3 dB loss and so this geometry is used primarily when amplifiers are used at each array element, as in many T/R module based arrays. In order to understand the advantages of the geometries 1B and 2 compared to that of FIG. 1A, consider a basic array example wherein the subarrays are used to incorporate time delay into a wide band phase scanned array. In this example, the basic contiguous array is to be formed of 16 subarrays (nt=16) with subarray spacing Dx=16 wavelengths, and half wavelength spacing (d) between elements, so that each subarray of the contiguous geometry (FIG. 1A) has 32 elements. The array is scanned to 18 degrees and the chosen frequency is 5% above center frequency. Time delay units are placed at the subarray ports and set appropriately. In this application to wide band arrays, the array phase shifters are set to produce a progressive phase distribution by setting each n'th phase shifter to the angle $\phi_n=(2\pi/\lambda o)nduo$, corresponding to scan angle uo at wavelength λo and time delay units at the subarray input ports. At any other wavelength λ, the subarray centers are moved to u=(λo)uo, and the subarray widths are changed because every point u on the curve (FIG. 3) is scaled by the factor λo, and the subarray widths are changed because every point u on the curve (FIG. 3) is scaled by the factor λo/λ. Applying time delayed signals to the subarray input ports causes the array beam to peak at the desired scan angle. The behavior of the three systems can be explained by comparing the subarray patterns. The subarray pattern of the uniformly illuminated subarray is a modified sin x/x function. It is known to have sidelobes as high as −13 dB, and so has grating lobes up to that level for these applications. The overlapped subarray feeds (1B or 2) produce the shaped patterns that enable the applications considered. First assume that all phase shifters are set to a constant, so that the array and subarray patterns radiate broadside. FIG. 3 shows subarray aperture distributions for the first four of a symmetric group of 8 subarrays formed using a feed with M=8, and N=256. The edge subarrays (numbered p=1 through 8) are truncated and so FIG. 4 shows the central subarray patterns p=3,4(5,6 not shown) to be much smoother than that of the edge subarrays p=1,2(7,8 not shown). These patterns are plotted with abscissa u=sinθ for the angle λ measured from the perpendicular to the array. When this group of 8 subarrays is used as an array section contiguous with other similar sections, there are periodic discontinuities introduced into the aperture illumination that produce grating lobes with period λ/(MDx).

Figure 5:
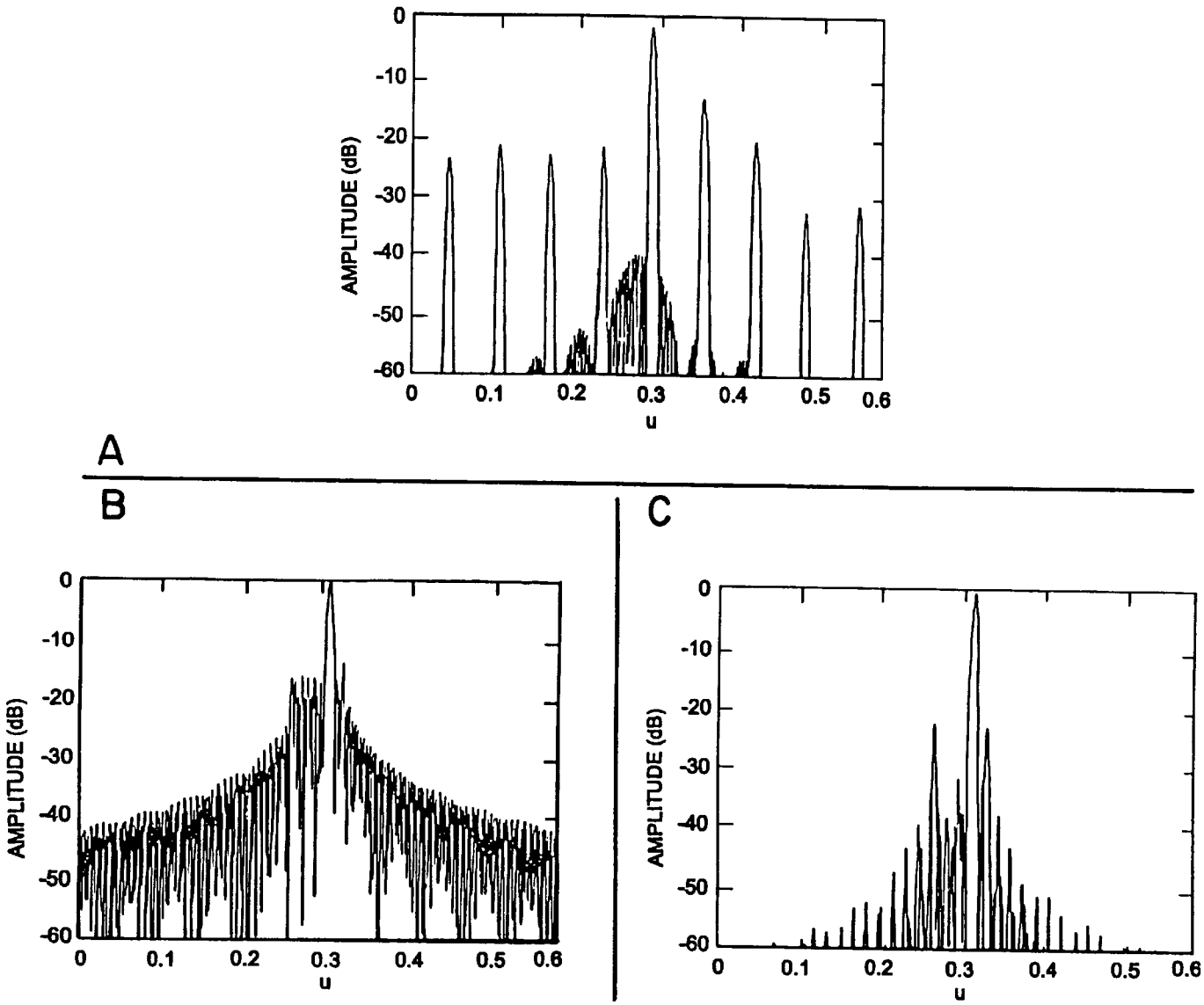

FIGS. 5A and B compare the patterns of the array of 16 contiguous, uniformly illuminated subarrays with that of an array of two contiguous array sections, with each sector containing 8 fully overlapped subarrays. Each array consists of 512 elements. This comparison shows significantly reduced sidelobes for the array of overlapped sections (5B) as compared with the array of uniform illuminated subarrays because all but the edge subarrays in each section have well formed flat tops and low sidelobes. When the network of FIG. 2 is employed to form the same number of subarrays, a total of four M×N transformer networks is required. These networks form 32 subarrays in all (M=8) and since only the central 4 out of each 8 are used, they present the same total of 16 subarrays. FIG. 5C shows the broadside pattern of this antenna indicating high quality patterns. The resulting pattern still has grating lobes, but the largest are not above −24 dB. The grating lobes are further apart than the pattern of 5B, due to the repeated aperture illumination every M/2 subarrays. This pattern thus has grating lobes separated by 2λ/MDx). Thus, for this application the geometry of 1B produces lower sidelobes than the array of contiguous uniform subarrays, and that of FIG. 2 produces a significant further improvement.

Figure 6:
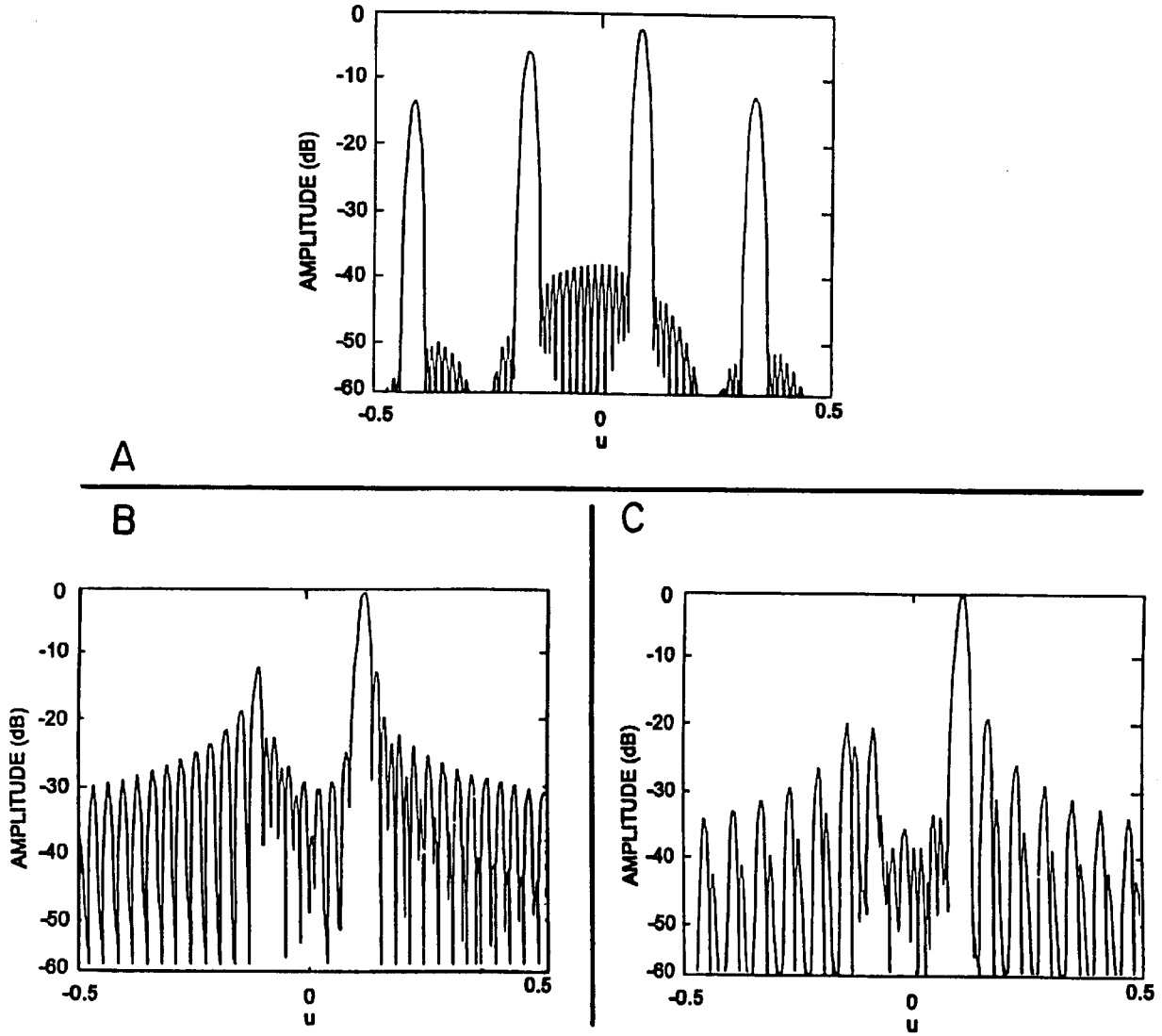

These subarraying techniques also have application to "limited field of view" (LFOV) arrays. FIG. 6 illustrates the behavior of these three subarray types using in-phase subarray apertures and phase shifters at the subarray ports. It is known that the maximum scan angle for such a configuration is (0.5λ/Dx) for an idealized very large array (so that the bandwidth is vanishingly small). In order to demonstrate the performance of the new subarray techniques for the LFOV application, the subarray dimensions are reduced from those of the previous example. The dimensions selected for FIG. 6 are Dx=4λo(8 elements per subarray for the circuit of 1A), nt=16 and N=64. The complete array thus has 128 elements. With this selection the number of input ports M is N/(2d) (for half wave spacing). FIG. 6 compares radiation patterns at uo=0.1 (or 5.7 degrees)for the three types of subarrays. Here again, comparing 6A and 6B it is clear that the uniform contiguous subarrays of 6A produce a pattern with very large, well defined grating lobes spaced λ/(MDx)(about 0.03) apart. However, the peak lobes are less than −12 dB below the main peak, and far sidelobes further suppressed. FIG. 3C shows that the partial of overlapped sections result in fewer (half as many) and smaller grating lobes, with all below −20dB.

While the invention has been described in its presently preferred embodiment it is understood that the words which have been used are words of description rather than words of limitation and that changes with the purview of the appended claims may be made without departing from the scope and spirit of the invention in its broader aspects.

What is claimed is:

1. An overlapped subarray system for use with a transmitter and comprising:

a set of planar radiating elements which are divided into overlapping subarrays, said set of overlapping subarrays being adjacent and non-contiguous subarrays that share at least one common radiating element; and a constrained feed means which connects said transmitter with said overlapping subarrays, wherein said constrained feed means comprises a set of Rotman lenses.

2. An overlapped subarray system for use with a transmitter and comprising:

a set of planar radiating elements which are divided into overlapping subarrays said set of planar radiating elements being adjacent and non-contiguous subarrays that share at least one common radiating element; and a constrained feed means which connects said transmitter with said overlapping subarrays, wherein said constrained feed means comprises a set of Butler matrices.

* * * * *